United States Patent [19]

Ueda et al.

[11] 4,368,990

[45] Jan. 18, 1983

[54] ELECTRONIC TIMEPIECE

[75] Inventors: Makoto Ueda; Masaharu Shida; Akira Torisawa, all of Tokyo, Japan

[73] Assignee: Kabushiki Kaisha Daini Seikosha, Tokyo, Japan

[21] Appl. No.: 128,402

[22] Filed: Mar. 10, 1980

Related U.S. Application Data

[63] Continuation of Ser. No. 898,535, Apr. 20, 1978, Pat. No. 4,209,971.

[30] Foreign Application Priority Data

Apr. 23, 1977 [JP] Japan ..... 52-47093

[51] Int. Cl.[3] ..... G04F 5/00; G04C 3/00

[52] U.S. Cl. ..... 368/157; 368/217; 318/696

[58] Field of Search ..... 368/66–76, 368/80, 85–87, 155–160, 217–219; 318/696

[56] References Cited

U.S. PATENT DOCUMENTS

| | | | |
|---|---|---|---|
| 3,855,781 | 12/1974 | Chihara et al. | 368/28 |
| 4,032,827 | 6/1977 | Dobratz | 318/696 |
| 4,114,364 | 9/1978 | Takahashi | 368/66 |
| 4,208,886 | 6/1980 | Regnier | 368/77 |

*Primary Examiner*—Vit W. Miska

*Attorney, Agent, or Firm*—Robert E. Burns; Emmanuel J. Lobato; Bruce L. Adams

[57] ABSTRACT

An analog electronic timepiece has a stepping motor for rotationally driving the timepiece hands. The motor is driven by normal driving pulses during normal load conditions and in the event the normal driving pulses are unable to effect rotation of the motor, correction driving pulses of longer pulse width than the normal driving pulses are used. A detection circuit detects whether or not the motor has rotated by switching a resistance element in series with the motor drive coil after the application of each normal driving pulse. Rotation and non-rotation of the motor is determined by measuring the voltage across the resistance element and comparing the measured voltage with a reference voltage.

5 Claims, 15 Drawing Figures

Fig.7
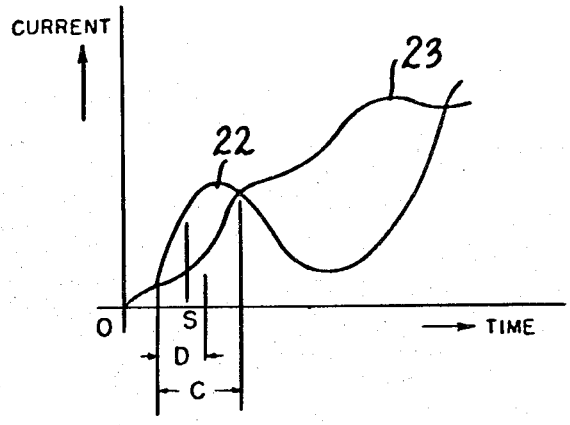
Fig.8
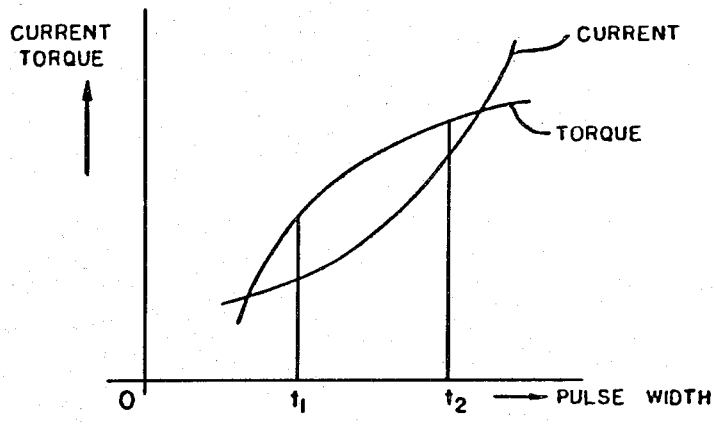
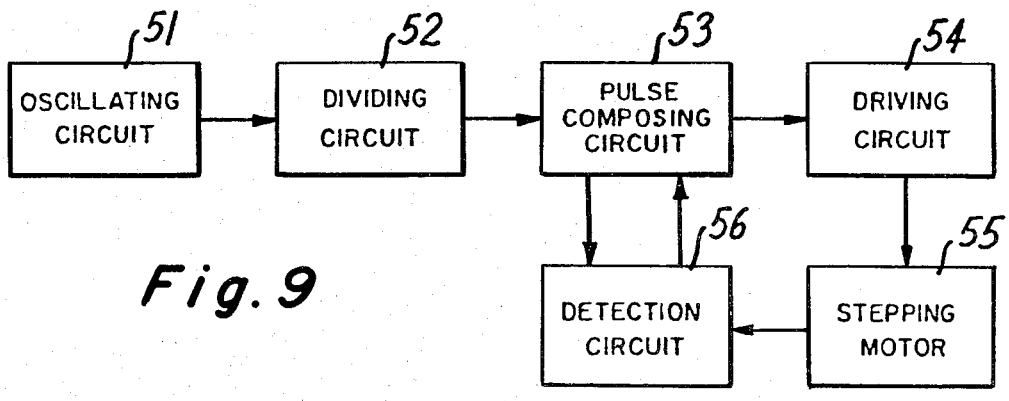
Fig.9

1"CORRECTION PULSE
1"PULSE
F/F
1/2 Hz
CL
R
S
Q
A
B
C
D
E
F
G
54
56
536
536
110
112
113
114
115
116
117a
117b
118
119
120
121
100
101
102
103
104
105
106
107
130
131
132
134
155
$V_D$
$\phi$

ELECTRONIC TIMEPIECE

This is a continuation of application Ser. No. 898,535, filed Apr. 20, 1978, now U.S. Pat. No. 4,209,971.

BACKGROUND OF THE INVENTION

A conventional display mechanism of an analogue quartz crystal wrist watch is composed as shown in FIG. 1.

An output from a motor composed of a stator 1, a coil 7 and a rotor 6 is transmitted to a fifth wheel and pinion 5, a fourth wheel and pinion 4, a third wheel and pinion 3, a second wheel and pinion 2, and thereafter the output is transmitted to a cannon pinion, a cannon wheel, a calendar mechanism though not shown to thereby drive a second wheel, a minute wheel, an hour wheel and a calendar. Though a load upon a stepping motor of a wrist watch is very small except when the calendar is advanced, for instance, the load of 1.0 g-cm torque is present in the case of a center wheel and pinion, however, twice as much torque is necessary in the case when the calendar is advanced. Accordingly, there is a problem that a power to stably drive the calendar mechanism is usually supplied though it takes no more than six hours to advance the calendar in 24 hours, by the reasons mentioned above. The circuit composition of the conventional electronic watch is shown in conjunction with FIG. 2.

A 32.768 KHz signal of an oscillating circuit 10 is transduced to a one second signal by a dividing circuit 11. The one second signal is transduced into a signal of 7.8 msec in width, with a 2 second period by a pulse width composing circuit 12 and is applied to inputs 15, 16 of inverters 13*a*, 13*b*, there is fed the signal of the same period and the same pulse width, whereby an inverted pulse, the direction of current flow of which changes each second is applied to a coil 14, and thereby the rotor 6, two poles of which are magnetized, magnetized rotates in one direction.

FIG. 3 shows a current wave form of the coil. Thus, the driving pulse width of the conventional electronic wrist watch is settled by taking a maximum torque as a standard, whereby the power is wasted during the time period which does not require a large torque and as a result a reduction of the electric power consumption is not realized.

SUMMARY OF THE INVENTION

Therefore, the present invention aims to eliminate the above noted difficulty and insufficiency, wherein the motor is driven with a smaller pulse width than the conventional type, and thereafter a detection pulse is applied to the coil to thereby examine whether the rotor rotates or not. The rotation of the rotor is detected by the voltage level of a resistance element inserted in series with the coil, and if the rotor does not rotate, the motor is driven with a wider pulse width to thereby correct the time.

BRIEF DESCRIPTION OF THE DRAWINGS

FIG. 7 is a wave form diagram of the current in the drive coil;

FIG. 8 is a graph of the driving pulse width of a stepping motor with respect to electric current and torque;

FIG. 9 is a block diagram showing an electronic timepiece according to the present invention;

DETAILED DESCRIPTION OF THE INVENTION

Figure 1:
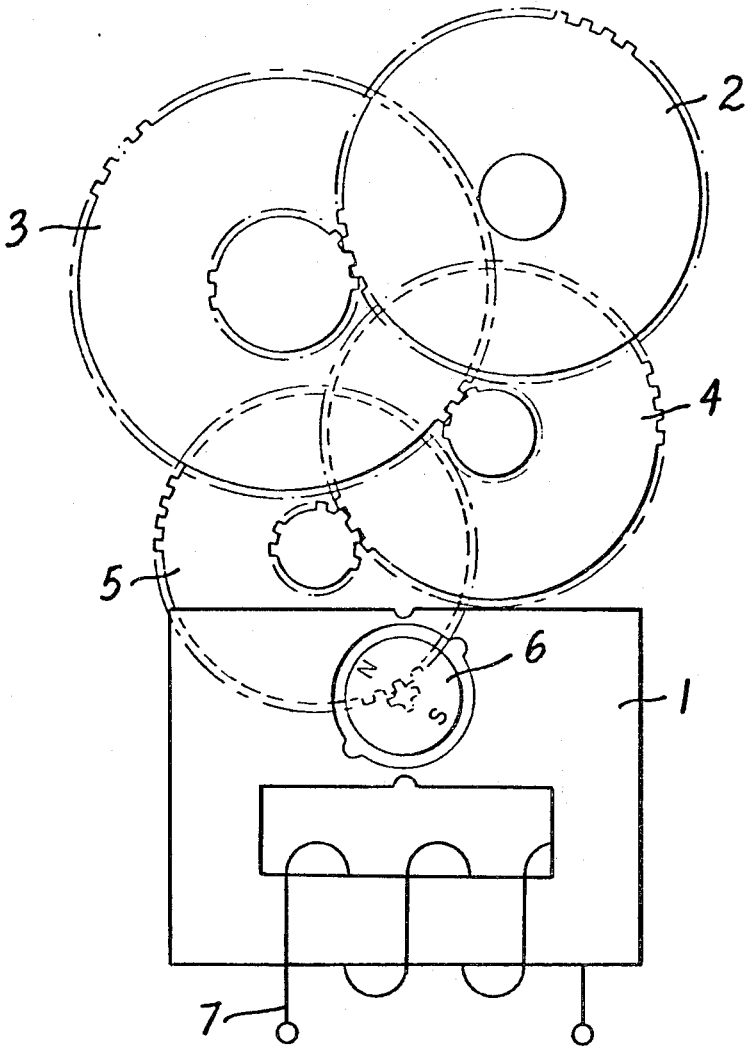
Fig. 1 PRIOR ART
FIG. 1 is an explanatory view of an indicating mechanism of an analog electronic timepiece.
Figure 2:
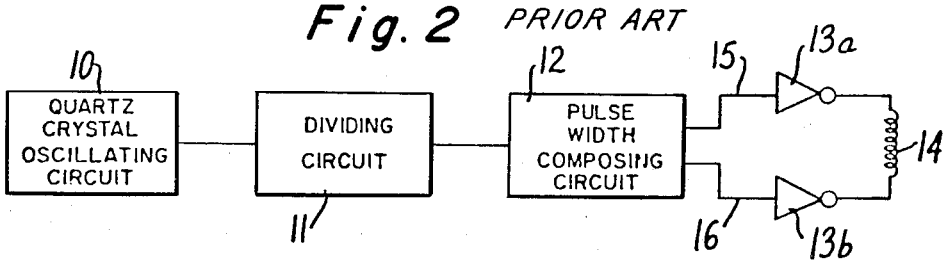
Fig. 2 PRIOR ART
FIG. 2 is a block diagram of a circuit of a conventional analog electronic timepiece.

The preferred embodiments of the present invention are now discussed in conjunction with the drawings.

FIG. 9 is a block diagram of an electronic timepiece according to the present invention, wherein numeral 51 represents a quartz crystal oscillating to generate circuit which oscillates the signal used for a reference signal of the timepiece. A dividing circuit 52 is composed of flipflops of multiple steps which divide the oscillating signal of the quartz crystal into a one second signal necessary for the timepiece. A pulse composing circuit 53 composes a normal driving pulse signal having a time width necessary for driving under normal loading, a correction driving pulse signal necessary for correction driving under worst case loading and a detection pulse necessary for detection out of each of the flipflop outputs of the dividing circuit 52. Further, the pulse composing circuit 53 combines the above signals to thereby transduce into the signal suitable for actuating a driving circuit 54 and a detection circuit 56.

The driving circuit 54 drives a stepping motor 55 receiving a normal driving pulse signal produced from the pulse composing circuit 53.

The detection circuit 56 receives the detection pulse produced from the pulse composing circuit 53 to detect the rotation and non-rotation of the stepping motor 55 and the result is fed back to the pulse composing circuit 53.

A rotor of the stepping motor 55 rotates in the case of a light load by the application of the normal driving pulse, while the rotor does not rotate in the case of heavy load. When the detection signal is applied to the detection circuit 56, the rotation and non-rotation of the rotor can be detected by the difference between the coil inductances caused by the rotation and non-rotation of the rotor. The pulse composing circuit 53 receives the signal produced from the detection circuit 56 and applies the correction driving pulse to the driving circuit 54 when the rotor does not rotate.

The pulse width of the correction driving pulse is wider than the normal pulse and thereby the torque is large and the correction driving pulse can drive even under heavy load.

The rotation principle and the detection principle of rotation and non-rotation of the stepping motor used for an electronic wrist watch according to the present invention is explained thereinafter.

Figure 4:
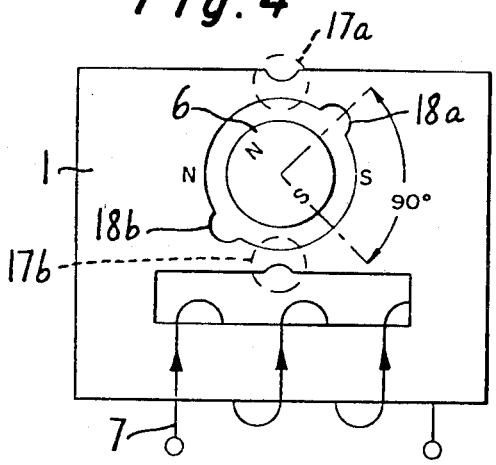
FIGS. 4–6 are explanatory diagrams of the operational principle of a stepping motor.

In FIG. 4, numeral 1 represents a stator composed as one body with saturable portions 17*a*, 17*b* made to be easily saturated and which magnetically fits with a magnetic coil around which a coil 7 is wound, though not clearly shown in the drawing. On the stator there is provided a notch 18*a*, 18*b* to decide a rotating direction of the rotor 6 which is magnetized on two poles. FIG. 4 shows the state just after an electric current is applied to the coil 7. When the electric current is not applied to the coil 7, the rotor 6 is inactive at the position where the notch 18*a*, 18*b* is at about a right angle with the magnetic core of the rotor. If the electric current is applied to the coil 7 in the direction shown by the arrow, a magnetic pole is generated on the stator 1 as shown in FIG. 4 and the rotor repulses and rotates CW. When the current in the coil is cut off, the rotor 6 is inactive in the state where the magnetic pole is in reverse with FIG. 4. Thereafter, the rotor 6 continues to rotate CW in turn by the current flow through the coil 7 in reverse direction.

Figure 3:
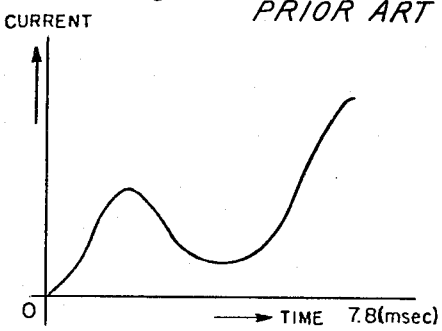
Fig. 3 PRIOR ART
FIG. 3 is a wave form diagram of current flow in a drive coil.

The stepping motor used in the electronic wrist watch according to the present invention is composed of a stator formed as one body and having saturable portions 17*a*, 17*b*, whereby the current wave form in the coil 7 shows a gentle rising characteristics as shown in FIG. 3. This is because the magnetic resistance of the magnetic circuit to be measured from the direction of the coil 7 is very low until the saturable portion of the stator 1 saturates, and thereby a resistance R and the time constant $\tau$ of a coil series circuit becomes large. The above explanation is formulated as follows:

$$\tau = C/R,\ L \approx N^2/Rm\ \tau = N^2/(R \times Rm)$$

where L: inductance of the coil 7, N: number of turns of the coil 7, Rm: magnetic resistance. When the saturable portions 17*a*, 17*b* of the stator 1 saturate, the magnetic permeability of the saturated portions become the same as that of air, whereby Rm increases, the time constant $\tau$ of the circuit becomes smaller and the current wave form abruptly rises as shown in FIG. 3. The detection of rotation and non-rotation of the rotor 6 used in the electronic watch according to the present invention is understood as the difference between the resistance and the time constant of the coil series circuit.

The reason for the difference in the time constant will now be explained.

Figure 5:
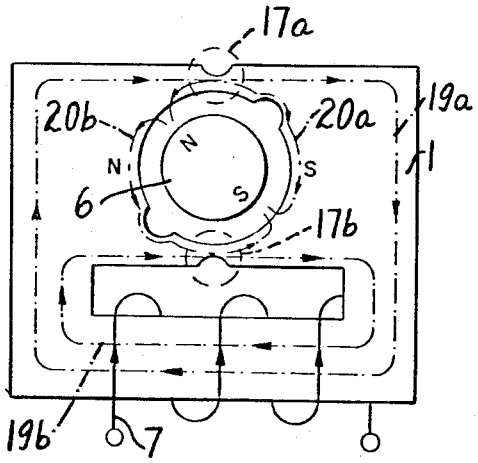

FIG. 5 shows the state of the magnetic field when there is a current in the coil 7, wherein the magnetic pole of the rotor 6 is at the rotatable position. A series of magnetic flux lines 20*a*, 20*b* show the magnetic flux generated from the rotor 6 and though not shown in the drawing, the magnetic flux interlocks with the flux generated by the coil 7. Magnetic flux lines 20*a* and 20*b* traverse the saturable portions 17*a* and 17*b* of the stator 1 in the direction of the arrows in FIG. 5. In many cases the saturable portions 17*a*, 17*b* do not saturate. In this state the current is started in the coil 7 as shown by way of the arrows in order to rotate the rotor CW. Magnetic fluxes 19*a*, 19*b* caused by the coil 7 and the magnetic fluxes caused by the rotor 6 respectively strengthen each other, whereby the saturable portions 17*a*, 17*b* saturate immediately. After this the magnetix flux sufficient to rotate the rotor 6 is generated from the rotor 6 though not shown in FIG. 5. The wave form of the current in the coil 7 in that instant is shown by way of numeral 22 in FIG. 7.

Figure 6:
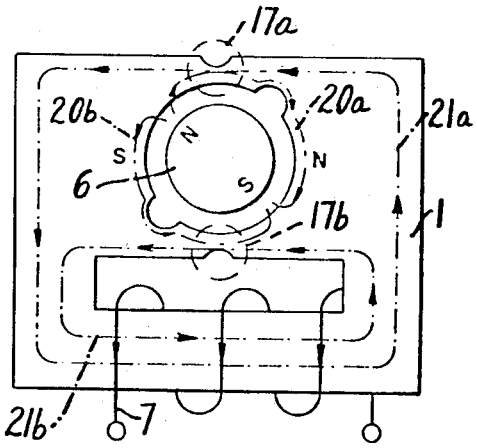

FIG. 6 shows the state of the magnetic flux in the case where the rotor 6 turns back halfway by some reason or other and the current is present in the coil 7. Though the current in the coil 7 is to be flowing in the reverse direction of the arrows in FIG. 6, i.e. the same direction with the arrows in FIG. 5 originally, because of the inverted current, the direction of the current changes per one rotation, is applied to the coil 7, and the magnetic flux in the case where the rotor cannot rotate is as shown in the drawing. The direction of the magnetic flux caused by the rotor 6 is the same as FIG. 5 since the rotor 6 does not rotate. The current in the coil 7 is in the reverse direction of that of FIG. 5, whereby the direction of the magnetic flux is as designated by 21*a* and 21*b*. The magnetic fluxes caused by the rotor 6 and the coil 7 cancel each other at the saturable portions 17*a* and 17*b* of the stator 1 and thereby it takes a longer time to saturate the saturable portion of the stator 1. The wave form 23 shows the condition as mentioned above. According to the embodiment, in a stepping motor with the diameter of the coil wire: 0.23 mm, number of turns: 10000, coil DC resistance: 3 KΩ, rotor diameter: 1.3 mm and the minimum width of the saturable portion: 0.1 mm, the time difference D in FIG. 7 until the saturable portion 17 of the stator 1 saturates is 1 msec. As clarified by a couple of electric current wave forms 22 and 23 in FIG. 7, the inductance in the coil is small when the rotor rotates and is large when the rotor does not rotate, within the range C. In the stepping motor of the above mentioned specification, the equivalent inductance within the range D is L=5 henry in the current wave form 22 when the rotor 6 rotates and L=40 henry in the current wave form 23 when the rotor 6 does not rotate. If the coil DC resistance RΩ and the resistance rΩ as the passive element for detection are connected with the inductance in series and altogether connected with the power source VD, the variation of the inductance is easily detected by detecting the voltage developed across the resistance element for detection as the threshold voltage Vth of a C MOS gate, i.e. the voltage $\frac{1}{2}$ VD. The following equation is lead to by the voltage $\frac{1}{2}$ VD developed across the resistance r.

$$(\tfrac{1}{2})\cdot VD = r/(R+r)\cdot[1 - E \times P(-(R+r)\cdot t/L)]\cdot VD$$

If the values R=3 KΩ, t=1 msec and L=40 henry are substituted for the above equation, r=29 KΩ. On the other hand, since the saturation period of the current wave form 22 in FIG. 7 is about 0.4 msec, r is 7.1 KΩ when the values R=3 KΩ, t=0.6 msec and L=5 henry are substituted for the above equation. Namely the resistance element for detection can range between 7.1 KΩ and 29 KΩ. The values calculated from the above equation coincide with experimental results.

Though the resistance element is used for the detecting element according to the embodiment of the present invention, it is to be understood that the passive elements such as a coil, condenser or the like and the active elements such as a MOS transistor or the like can be used as well.

As illustrated above, the rotation and non-rotation of the rotor 6 can be judged by the application of the detection signal, and thereby the motor ordinarily drives with low torque with a short pulse width, while the motor drives with high torque with a long pulse width for correction when the rotor 6 does not rotate under high load.

The pulse width is decided by the pulse width and curve lines of current and torque shown in FIG. 8 as follows: Namely, the short pulse width $t_1$ is determined by the minimum torque necessary for the normal stepping and the specification of the motor is chosen so that the motor drives at the maximum efficiency with the pulse width, thereby decreasing the current consumption as much as possible. The long pulse width $t_2$ for the correction driving is chosen so that the value of the torque of which is at maximum which is guaranteed as a timepiece. As described so far, a timepiece of small power consumption in comparison with the conventional type is obtained by choosing the pulse widths $t_1$ and $t_2$.

Further, the feature of the detecting portion of the electronic timepiece according to the present invention is that the rotation and non-rotation of the stepping motor can be detected without using an amplifier in particular. The rotation and non-rotation of the stepping motor is detected as follows: The resistance element, the dc resistance value of which is the same or larger than the coil 7, is temporarily inserted into the coil 7 in series at the point S in FIG. 7 and then the voltage developed across the inductance of the coil 7 and the voltage of the resistance determined by the partial pressure ratio of the resistance is applied to a C MOS gate. The above method will be illustrated more detail later.

FIG. 9 shows the constitution diagram of the electronic timepiece as a whole.

Numeral 51 represents a quartz crystal oscillating circuit (OSC) in general. The signal from OSC 51 is fed to a dividing signal (DIV) 52 which is composed of multiple steps of flipflops (hereinafter F/F) and divides the signal into a one second signal which is necessary in a timepiece. A pulse composing circuit 53 feeds a normal driving pulse and a drive correction pulse to a driving circuit (DRIVER) 54 and a detection pulse to a detection circuit 56. A driving signal is fed to a coil portion of a stepping motor (MOTOR) 55 from the driving circuit (DRIVER) 54. The detection circuit 56 judges the rotation and non-rotation of the rotor 6 by inductance variation, and the detection circuit 56 feeds the signal to the pulse composing circuit 53 if it detects the non-rotation.

Referring now to the pulse composing circuit 53, the driving circuit 54 and the detection circuit 56 which constitute the main part of the present invention.

Figure 10A:
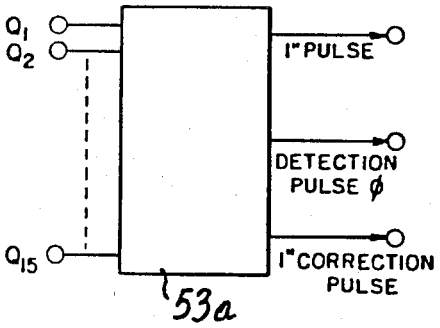
FIGS. 10(*a*) and 10(*b*) are respectively a block diagram and a time chart of an embodiment of a pulse composing circuit of the invention.
Figure 10B:
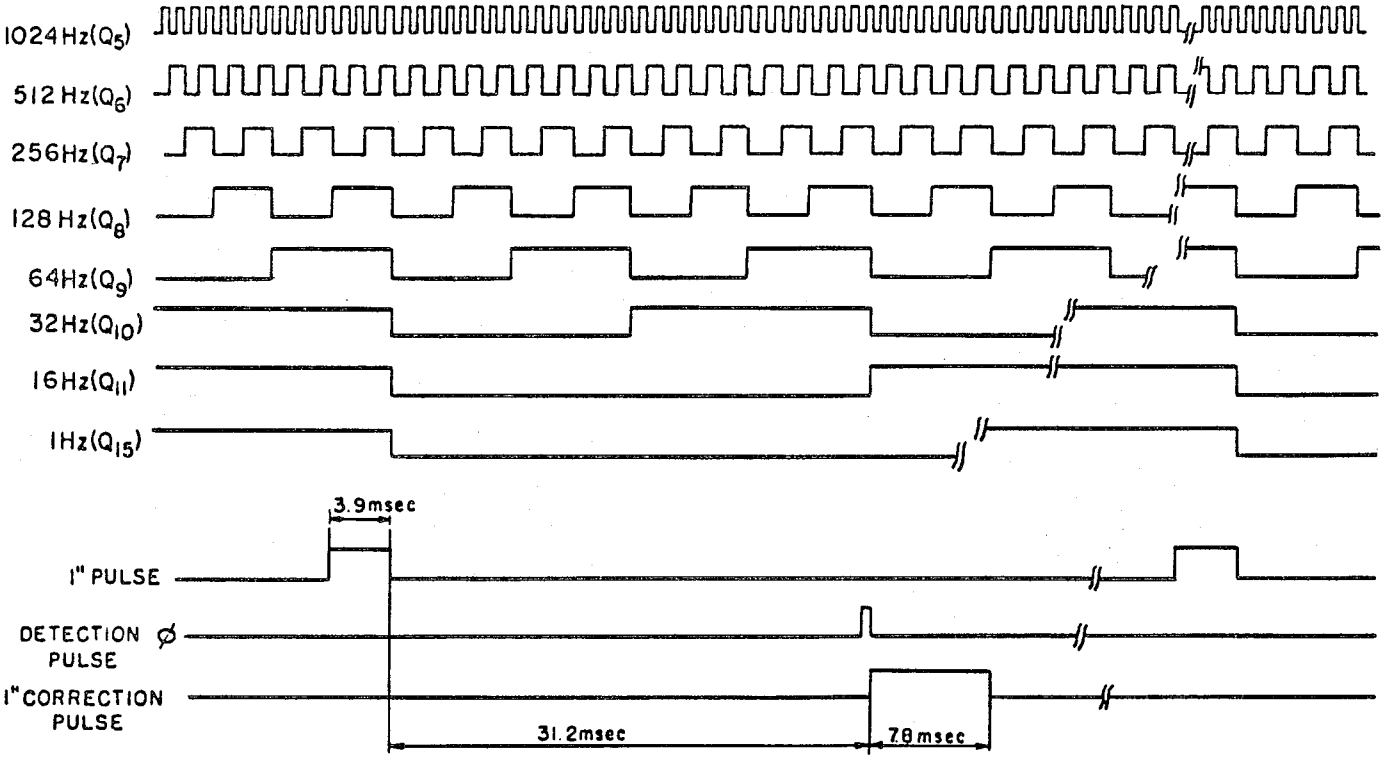

FIG. 10 is a partial time chart of the pulse composing circuit 53 and the block diagram whereof, showing 1" pulse, 1" correction pulse and a timing of a detection pulse $\phi$.

These signals can easily be composed of the composition of the gates of the outputs $Q_n$ from the dividing circuit 52.

The logical formulas of the signals are shown below.

$$1'' \text{ pulse} = Q_8 \cdot Q_9 \cdot Q_{10} \cdot \overline{Q_{11}} \cdot \overline{Q_{12}} \cdot \overline{Q_{13}} \cdot \overline{Q_{14}} \cdot \overline{Q_{15}}$$

$$1'' \text{ correction pulse} = \overline{Q_9} \cdot \overline{Q_{10}} \cdot \overline{Q_{11}} \cdot \overline{Q_{12}} \cdot \overline{Q_{13}} \cdot \overline{Q_{14}} \cdot \overline{Q_{15}}$$

$$\phi = Q_5 \cdot Q_6 \cdot Q_7 \cdot Q_8 \cdot Q_9 \cdot Q_{10} \cdot \overline{Q_{11}} \cdot \overline{Q_{12}} \cdot \overline{Q_{13}} \cdot \overline{Q_{14}} \cdot \overline{Q_{15}}$$

provided that $Q_5$: 1024 Hz, $Q_4$: 512 Hz . . . $Q_{15}$: 1 Hz.

Accordingly, the pulse width of each of the signals are: 1" pulse: 3.9 ms, 1" correction pulse: 7.8 ms and $\phi$: 0.5 ms. The 1" pulse is referred to as the normal driving pulse and has a period of one second and a pulse width of 3.9 ms, and the 1" correction pulse is referred to as the correction driving pulse and likewise has a period of one second though has a longer pulse width of 7.8 ms.

These signals are fed to the circuit in FIG. 11 which will be subsequently illustrated and converted into the signals suitable for driving the driving circuit 54 or the like.

Figure 11A:
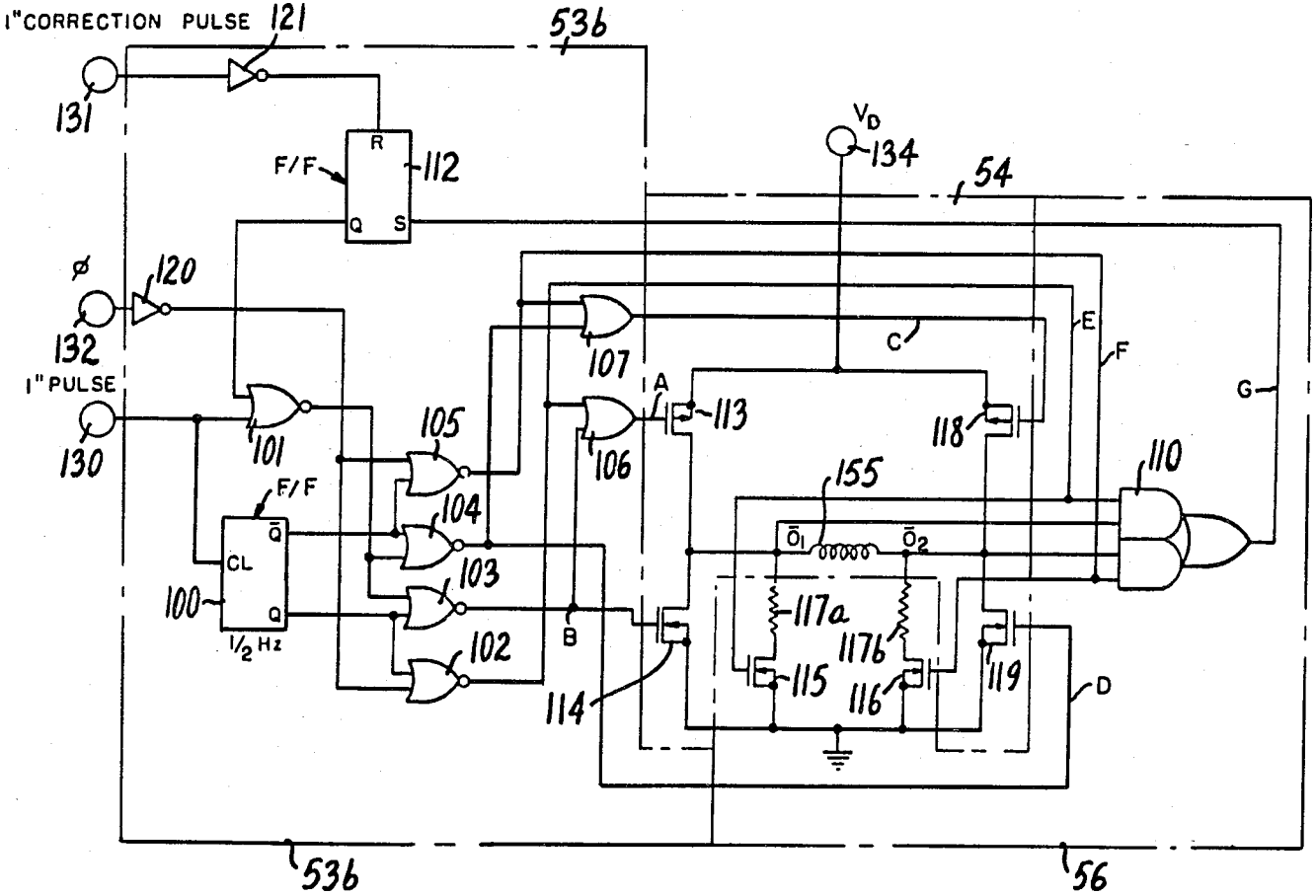
FIGS. 11(*a*) and 11(*b*) are respectively an embodiment of a circuit diagram and a time chart of a pulse composing circuit, detection circuit and a driving circuit of the invention.
Figure 11B:
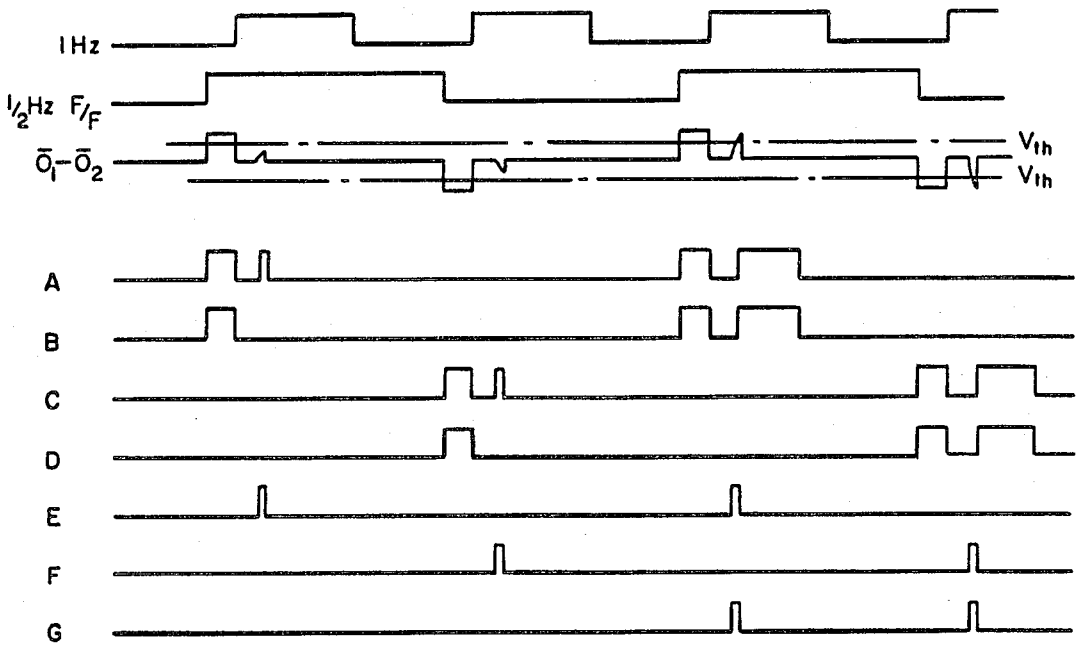

FIG. 11 is an embodiment of the pulse composing circuit 53, the driving circuit 54 and the detection circuit 56, wherein numeral 100 represents a F/F which produces a ½ Hz signal and the outputs thereof are respectively connected with NOR gates 102 and 103, while the inverse outputs thereof are respectively fed to the first inputs of NOR gates 104 and 105.

To a NOR gate 101 there is fed the one second normal driving pulse and the one second correction driving pulse from an R-S F/F 112 in the case when the rotor does not rotate and the output is connected with the second input of the NOR gates 103 and 104.

The detection pulse $\phi$ which is a part of the pulse composing circuit in FIG. 10 is applied to the second input of the NOR gates 102 and 105 by way of the inverter 120.

The output from the NOR gate 102 is connected to the input of an N MOS FET 115 and the first input of an OR gate 106 and the input of an AND-OR gate 110.

The output from the NOR gate 103 is connected to the input of an N MOS FET 114 for motor driving and the second input of the OR gate 106.

The output from the NOR gate 104 is connected to the input of an N MOS FET 119 for motor driving and the first input of an OR gate 107.

The output from the NOR gate 105 is connected to the input of an N MOS FET 116 and the second input of the OR gate 107 and the AND-OR gate 110.

The output from the OR gate 106 is connected to a P MOS FET 113 for motor driving and the output from the OR gate 107 is connected to a P MOS FET 118 for motor driving.

The one second correction pulse is fed to the present terminal of the R-S F/F 112 from a terminal 131 by way of an inverter 121.

The above is the composition of a part 53-*b* of the pulse composing circuit and the composition of the driving circuit 54 and the detection circuit 56 is now referred to.

Numeral 134 represents a + terminal of the power source, applied whereto the supply voltage VD and sources of the P MOS FETs 113 and 118 are respectively connected.

The sources of the N MOS FETs 114 and 119 are grounded, while the drains of the P MOS FET 113 and N MOS FET 114 are connected to each other and also respectively connected to an end of a coil 155 of the stepping motor 55 and the drain of the N MOS FET 115 for detection.

The drains of the P MOS FET 118 and the N MOS FET 119 are connected to each other and further connected to the other end of the coil 155 of the stepping motor 55 and the drain of the N MOS FET 116 for detection.

The source of the N MOS FET 115 is grounded and the drain thereof is connected to a junction of the P MOS FET 113, the N MOS FET 114 and the coil 155 by way of a resistance element 117-*a*. The N MOS FET 116 is connected to a junction of the P MOS FET 118, N MOS FET 119 and the coil 155 by way of a resistance element 117-*b*.

The voltage across the coil is fed to the AND-OR gate 110 and the output therefrom is fed to the setting terminal of the R-S F/F 112.

The operation of the circuit composition as mentioned above is as follows:

When the output Q of the F/F 100 is "H", the output from the NOR gate 101 is "L" and to input terminals of the NOR gate 104 there are fed "L" signals and then the output from the NOR gate 104 is "H", and the output from the OR gate 107 is "H", and thereby the P MOS FET 118 is OFF and the N MOS FET 119 is ON.

At this time the current flows through the coil 155 and the motor rotates. The similar operation will be explained when the output Q of the F/F 100 is "L", in which the N MOS FET 114 is ON and the current flows through the opposite direction as above and the motor rotates.

When the detection pulse $\phi$ is applied to the terminal 132, when the output Q of the F/F 100 is "H", the output from the NOR gate 105 is "H" and the signal flows through the P MOS FET 113, the coil 155, the resistance element 117-*b*, the N MOS FET 116, to the ground in series and the voltage in proportion to the current develops across the N MOS FET 116 and the resistance element 117-*b*.

Figure 12:
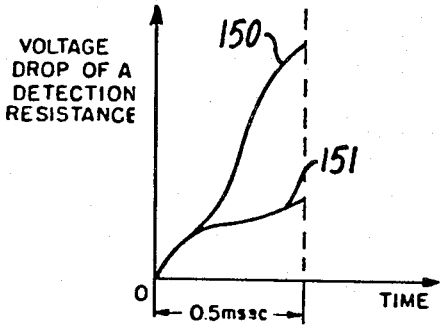
FIG. 12 shows a characteristic of the voltage drop of the detection resistance for an hour.

Accordingly, the wave form of the rotor rotating with 1" pulse is as shown by way of 151 in FIG. 12 and the wave form thereof when the rotor does not rotate is as shown by way of 150 in FIG. 12, and by setting the threshold voltage of the C-MOS gate 110 at the center of the voltage at 0.5 msec, the non-rotation signal of the rotor is easily produced from the comparator. If the rotor does not rotate, the output from the AND-OR gate 110 is "H" and the R-S F/F is set and the output Q is "H" and continues the correction driving until the output Q is set by the 1" correction pulse.

Figure 13:
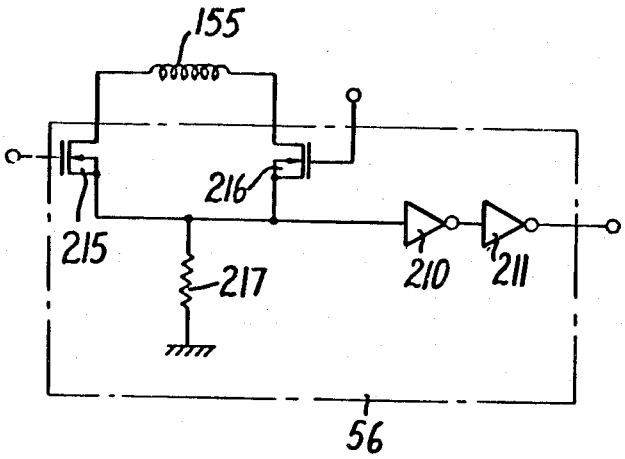
FIG. 13 is a second embodiment of a detection circuit of the invention.

The operation is explained in the same way in the case where the output Q of the F/F 100 is "L". Moreover, the detection circuit 56 according to the present invention can also be achieved by the circuit composition as shown in FIG. 13. In the circuit composition, the gate of an N MOS FET 215 is connected to the output terminal of the NOR gate 102 in FIG. 11(*a*) and the gate of an N MOS FET 216 is connected to the output terminal of the NOR gate 105 in FIG. 11(*a*). The drain of the N MOS FET 215 is connected to one end of the coil 155 and the drain of the N MOS FET 216 is connected to the other end of the coil 155.

The source of the N MOS FETs 215 and 216 are connected each other and one end of a resistance element 217 for detection is connected with a junction of the N MOS FETs 215 and 216 and the other end of the resistance element 217 is grounded. The junction of the N MOS FETs 215 and 216 is also connected to a C MOS gate 210 and the output thereof is connected to a C MOS gate 211 and further the output thereof is connected to the setting input of the R-S F/F 112 in FIG. 11(*a*). The operation of the detection circuit mentioned above is almost the same as the detection circuit 56 in FIG. 11(*a*) and when the detection pulse $\phi$ is applied to the detection circuit, the voltage wave form is the same as that of FIG. 12 developed across the resistance element 217.

The difference between the conventional detection circuit in FIG. 13 and the detection circuit 56 in FIG. 11(*a*) according to the present invention is the size when it is mounted on an IC and the resistivity of the ON resistance of N MOS FET.

By way of example, the size of the N MOS FETs 215 and 216 in FIG. 13 and the size of the N MOS FETs 115 and 116 in FIG. 11(*a*) when they are mounted on IC are compared.

In FIG. 13, if the electric potential of the source of the N MOS FETs 215 and 216 is one half of the supply voltage, i.e. 1.57 V/2, the threshold voltage thereof is 0.5 V and the ON resistance thereof is 1 KΩ, and the resistance of the resistance element 217 is 15 KΩ, the current flowing into the N MOS FETs 215 and 216 is:

$$i = 1.57/2 \times 15000 = 52.3\ (\mu A)$$

and the electric potential between the drain and source VDS is:

$$VDS = 1000\ (\Omega) \times 52.3\ (\mu A) = 0.0523\ (V)$$

whereby K value ($\mu A/V^2$) is:

$$K = i(\mu A)/[2(VD - VSB - VTH) \times VDS - VDS^2]$$

provided that,

VD (the supply voltage) = 1.57 (V)

VSB (the electric potential between the source and board) = 1.57/2 (V)

VDS (the electric potential between the source and drain) = 0.0523 (V)

i (the current flows across the drain and source) = 52.3 ($\mu$A)

$K \approx 2000\ (\mu A/V^2)$ if $K = K'W/(L - 2Xj)$, K' of N MOS FET $\approx 20\ (\mu A/V^2)$ and L(length) = 10 ($\mu$), and 2Xj(diffused width) = 8$\mu$, W(width) $\approx$ 500 ($\mu$)

Namely, the width of the N MOS FET 215 plus the N MOS FET 216 is 1000$\mu$ Similarly, the size of the N MOS FETs 115 and 116 in FIG. 11(*a*) is calculated. If VSB = 0 is substituted for the above equation, the ON resistance of the N MOS FETs 115 and 116 are both 1 KΩ, and the resistances of the resistance elements 117-*a* and 117-*b* are both 14 KΩ, $K \approx 480\ (\mu A/V^2)$, W(width) = 120 ($\mu$), whereby the size of the N MOS FETs 115 and 116 are 240 ($\mu$) in all.

On the other hand, though two resistance elements 117-*a* and 117-*b* are necessary in case of FIG. 11(*a*), the area occupied by the resistors is small if a P-Well diffusion resistance, the shield resistance of which is 5 KΩ, is used, and also the area occupied by the gates are small since the increase in number of gates is small.

The area occupied by IC 10($\mu$) × 100($\mu$) is very large, whereby the method shown in FIG. 13 has disadvantages with respect to the cost and decrease in yield, on the other hand, the method shown in FIG. 11 improves the above mentioned disadvantages and achieves a decrease in the power supply of the electronic timepiece.

Moreover, it is to be understood that the electronic timepiece comprising a motor, the coil inductance of which is different according to the condition of the rotor, i.e. whether the rotor rotates or not rotates, is included in the present invention.

We claim:

1. In an analog electronic timepiece: a stepping motor having a stator, a drive coil wound on the stator, and a rotor rotationally driven in a stepwise manner in response to driving pulses applied to the drive coil; circuit means for periodically producing normal driving pulses sufficient to drive the stepping motor under normal loading and insufficient to drive the stepping motor under worst case loading, and correction driving pulses sufficient to drive the stepping motor under worst case loading; driving circuit means connected to receive the normal driving pulses and the correction driving pulses for applying the same to the drive coil; and detecting means for detecting whether or not the rotor has rotated after each normal driving pulse is applied to the drive coil and coacting with the circuit means for effecting the application of a correction driving pulse to the drive coil in response to detection of non-rotation of the rotor, said detecting means comprising a resistance element, switching means for momentarily switching the resistance element into connection with the drive coil after the application of each normal driving pulse to the drive coil so that the voltage induced in the drive coil by the movement of the rotor causes current flow in the resistance element indicative of rotation or non-rotation of the rotor, and means for discriminating between rotation and non-rotation of the rotor by measuring the voltage across the resistance element.

2. An analog electronic timepiece according to claim 1; wherein said means for discriminating between rotation and non-rotation of the rotor comprises means for comparing the voltage across the resistance element with a predetermined reference voltage.

3. An analog electronic timepiece according to claim 2; wherein the means for comparing the voltage across the resistance element comprises a C-MOS element.

4. An analog electronic timepiece according to any of claims 1, 2 or 3; wherein the driving circuit means comprises a pair of two series-connected driving transistors connected in parallel, and means connecting the drive coil between connecting points of the two series-connected driving transistors; and means connecting the resistance element and switching means in series and connecting the series connection in parallel with the driving transistors to thereby control operation of the driving transistors according to detection of rotation and non-rotation of the rotor by the detecting means.

5. An analog electronic timepiece according to claim 4; wherein the detecting means comprises two resistance elements connected in series with the ends of the drive coil, and said switching means comprises two switching elements connected in series with respective ones of the resistance elements.

* * * * *